US007979200B2

(12) United States Patent
Bay et al.

(10) Patent No.: US 7,979,200 B2
(45) Date of Patent: Jul. 12, 2011

(54) MANAGING AN AIR-GROUND COMMUNICATIONS NETWORK WITH AIR TRAFFIC CONTROL INFORMATION

(75) Inventors: FM Bay, Sunnyvale, CA (US); David E. Walton, Montgomery Village, MD (US)

(73) Assignee: Lockheed Martin Corporation, Bethesda, MD (US)

( * ) Notice: Subject to any disclaimer, the term of this patent is extended or adjusted under 35 U.S.C. 154(b) by 867 days.

(21) Appl. No.: 11/940,913

(22) Filed: Nov. 15, 2007

(65) Prior Publication Data

US 2008/0120020 A1 May 22, 2008

Related U.S. Application Data

(60) Provisional application No. 60/866,563, filed on Nov. 20, 2006.

(51) Int. Cl.
*G08G 5/00* (2006.01)

(52) U.S. Cl. ..... 701/120; 342/32; 342/36; 342/42; 342/63; 342/104; 342/107; 701/300; 701/301; 701/302; 701/122

(58) Field of Classification Search ..... 455/403–457; 370/310–331, 340, 341
See application file for complete search history.

(56) References Cited

U.S. PATENT DOCUMENTS 5,123,112 A * 6/1992 Choate ..... 455/524
5,212,804 A * 5/1993 Choate ..... 455/431
5,249,303 A * 9/1993 Goeken ..... 455/431
5,459,469 A * 10/1995 Schuchman et al. ..... 342/37
5,493,309 A 2/1996 Bjornholt
5,574,648 A 11/1996 Pilley
5,627,546 A * 5/1997 Crow ..... 342/352
5,798,726 A * 8/1998 Schuchman et al. ..... 342/37
5,867,804 A 2/1999 Pilley et al.
5,890,079 A 3/1999 Levine
5,974,349 A 10/1999 Levine
6,006,158 A 12/1999 Pilley et al.
6,104,926 A * 8/2000 Hogg et al. ..... 455/431
6,133,867 A 10/2000 Eberwine et al.
6,154,151 A 11/2000 McElreath et al.
6,154,655 A * 11/2000 Borst et al. ..... 455/451
6,182,005 B1 1/2001 Pilley et al.
6,195,609 B1 2/2001 Pilley et al.
6,353,779 B1 * 3/2002 Simon et al. ..... 701/3
6,392,587 B1 5/2002 Langbecker et al.
6,430,412 B1 * 8/2002 Hogg et al. ..... 455/436
6,477,163 B1 * 11/2002 Miller ..... 370/347
6,477,370 B1 * 11/2002 Sigler et al. ..... 455/427
6,519,464 B1 2/2003 Santhoff et al.

(Continued)

*Primary Examiner* — Jack Keith
*Assistant Examiner* — Jonathan M Dager
(74) *Attorney, Agent, or Firm* — Marsh Fischmann & Breyfogle LLP

(57) ABSTRACT

Systems and methods that coordinate assignments of aircraft operating within a controlled airspace to ground radios are provided. In one embodiment, such a system includes an air traffic control (ATC) facility (12), a plurality of ground radios (16A-16C), and a network manager (20) communicatively coupled to the air traffic control facility (12) and the ground radios (16A-16C). The air traffic control facility is responsible for controlling aircraft (14A-14I) operating within the airspace (10) and providing ATC information to the network manager (20). The ground radios (16A-16C) are operable to provide communications between the air traffic control facility (12) and the aircraft (14A-14I). The network manager (20) is operable to assign each aircraft (14A-14I) to one of the ground radios (16A-16C) based on network management considerations using the ATC information.

22 Claims, 5 Drawing Sheets

U.S. PATENT DOCUMENTS 6,526,337 B2 * 2/2003 Gardner ..... 701/3
6,643,509 B1 * 11/2003 Crow ..... 455/431
6,677,888 B2 1/2004 Roy
6,760,778 B1 7/2004 Nelson et al.
6,768,906 B2 * 7/2004 Matthews et al. ..... 455/431
6,965,771 B2 11/2005 Rossi
7,020,708 B2 3/2006 Nelson et al.
7,072,977 B1 * 7/2006 Bernard et al. ..... 709/238
7,194,523 B2 * 3/2007 Nelson et al. ..... 709/218
7,313,143 B1 * 12/2007 Bruno ..... 370/395.4
7,359,703 B2 * 4/2008 McGuffin et al. ..... 455/431
7,751,815 B2 * 7/2010 McKenna et al. ..... 455/431
7,831,251 B2 * 11/2010 Karabinis et al. ..... 455/427
2002/0013149 A1 * 1/2002 Threadgill et al. ..... 455/427
2002/0147542 A1 * 10/2002 Tomescu ..... 701/120
2002/0155833 A1 * 10/2002 Borel ..... 455/431
2003/0021241 A1 1/2003 Dame et al.
2003/0030581 A1 2/2003 Roy
2003/0055975 A1 3/2003 Nelson et al.
2003/0083804 A1 5/2003 Pilley et al.
2003/0134647 A1 7/2003 Santhoff et al.
2003/0224796 A1 * 12/2003 Landes et al. ..... 455/446
2004/0193732 A1 * 9/2004 Nelson et al. ..... 709/246
2004/0214579 A1 10/2004 Mattila
2005/0108374 A1 * 5/2005 Pierzga et al. ..... 709/223
2005/0156777 A1 7/2005 King et al.
2005/0164664 A1 * 7/2005 DiFonzo et al. ..... 455/277.1
2005/0220055 A1 10/2005 Nelson et al.
2006/0046715 A1 * 3/2006 Burgemeister ..... 455/431
2006/0069497 A1 3/2006 Wilson, Jr.
2006/0106506 A1 * 5/2006 Nichols et al. ..... 701/3
2006/0167618 A1 * 7/2006 Werback ..... 701/120
2006/0178141 A1 * 8/2006 McGuffin et al. ..... 455/431
2006/0217851 A1 * 9/2006 McGuffin et al. ..... 701/4
2006/0276127 A1 * 12/2006 Cruz et al. ..... 455/12.1
2007/0025418 A1 * 2/2007 Bay et al. ..... 375/130
2007/0072560 A1 * 3/2007 Ishikawa ..... 455/101
2009/0103473 A1 * 4/2009 Foster et al. ..... 370/316
2009/0111465 A1 * 4/2009 Bruno et al. ..... 455/431
2009/0322586 A1 * 12/2009 Lanzkron ..... 342/36

* cited by examiner

MANAGING AN AIR-GROUND COMMUNICATIONS NETWORK WITH AIR TRAFFIC CONTROL INFORMATION

RELATED APPLICATION INFORMATION

This application claims priority from U.S. Provisional Application Ser. No. 60/866,563, entitled "MANAGING AN AIR-GROUND COMMUNICATIONS NETWORK WITH AIR TRAFFIC CONTROL INFORMATION" filed on Nov. 20, 2006, which is incorporated by reference herein in its entirety.

BACKGROUND OF THE INVENTION

The introduction of a digital network in an air-ground communication system carries two new problems: (1) the tracking of legacy analog users in the digital network; and (2) the assignment of radio and channel assets to each user to level the network loading and avoid communications traffic congestion and interference.

The second problem is exacerbated by the ability to reduce the number of radios deployed to serve the airspace because the assignment of specific radio equipment and frequencies to each airspace sector is eliminated by the digital network capabilities. Radio coverage and capacity become the limiting factors of infrastructure utilization instead of the current approach of controller workload (sectorization).

SUMMARY OF THE INVENTION

Accordingly, air traffic control (ATC) management information (e.g., location, intention, and capability of each individual aircraft) may be used to manage the assignment of radios and channels between the ground and airborne users to allow the greatest efficiency in digital network utilization and a minimum deployed asset base. In this regard, specific criteria and algorithms for making assignment decisions based on ATC information can be employed. Any scheme that breaks the 'one sector-one controller-redundant radios' philosophy will require the use of some air traffic management information in the assignment methodology. Unless the controller is expected to be provided radio and channel availability and the responsibility to make a selection, some automation will be required, especially during abnormal operations due to a ground radio outage.

In accordance with one aspect of the present invention, a system that coordinates assignments of aircraft operating within a controlled airspace to ground radios includes an air traffic control facility, a plurality of ground radios, and a network manager communicatively coupled to the air traffic control facility and the ground radios. The air traffic control facility is responsible for controlling air traffic with the airspace and providing ATC information to the network manager. The ground radios are operable to provide communications between the air traffic control facility and the aircraft. The network manager is operable to assign each aircraft to a ground radio based on network management considerations using the ATC information.

In another aspect of the present invention, a method of coordinating ground radio assignments for aircraft operating within a controlled airspace to ground radios includes the step of receiving a plurality of aircraft information inputs from, for example, an ATC facility. The method also includes the step of receiving a plurality of ground radio information inputs. In a further step, the aircraft information inputs and the ground radio information inputs are processed in view of network management considerations. In one more step of the method, an assignment to a ground radio for each aircraft within the airspace is established using the processed aircraft information inputs and the processed ground radio information inputs.

The use of the air traffic management knowledge base of the location, intention, and capability of each aircraft in the communications network management scheme allows an assessment of the current state and an efficient projection of the future state of the communications network workload (capacity demand). The projection of a future state should allow the minimum number of assignment changes in normal operations and should allow a continuous planning of the most efficient recovery assignments in the event of abnormal operations due to a ground radio failure.

The assignment of physical radios and available channels to each aircraft using the communications network is aligned with the current and projected network node (remote radio) workload. The elimination of the 'one sector-one controller-redundant radios' communications infrastructure philosophy through the introduction of the digital network requires an assignment and optimization logic for sizing the infrastructure. The use of the available, real-time air traffic management knowledge base will allow the requisite optimization with the actual conditions of the airspace. The more sophisticated the air traffic management knowledge becomes (via traffic flow management schemes), the better that knowledge applies to the management of the air-ground communications infrastructure.

A further advantage of the use of air traffic management information in making radio assignments is that the tracking of analog users in the digital air-ground network is simplified when the real-time air traffic management knowledge is applied. The analog user's location is provided to the communications network manager to minimize the possible remote network nodes (radios) that could serve the analog user. In conjunction with the use of vocabulary recognition technology, the reduced possibilities of user identity greatly improve the likelihood of correct user identification through the implementation of restricted recognition rules (e.g., a reduced vocabulary base to be recognized).

Another advantage is that 'on the fly' asset reallocation within the digital network to attain utilization efficiencies and avoid deployment of otherwise unnecessary assets is allowed. This should allow a graceful growth path as traffic density changes over time as the placement of radios will not be tied to geography, but rather to capacity.

These and other aspects and advantages of the present invention will be apparent upon review of the following Detailed Description when taken in conjunction with the accompanying figures.

DESCRIPTION OF THE DRAWINGS

For a more complete understanding of the present invention and further advantages thereof, reference is now made to the following Detailed Description, taken in conjunction with the drawings, in which.

DETAILED DESCRIPTION

Figure 1:
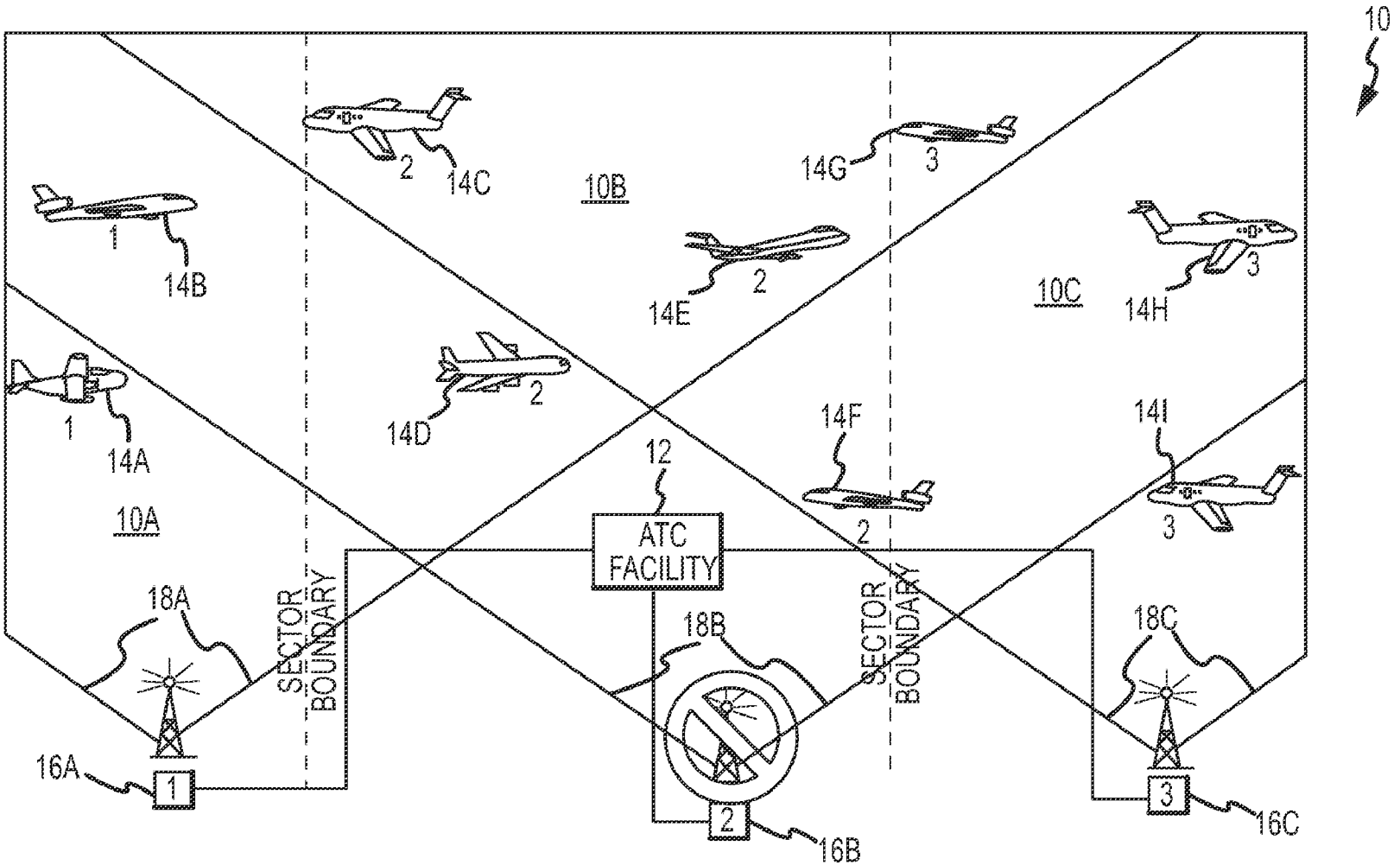
FIG. 1 is a diagrammatic representation of sector aligned radio assignments within an airspace.

FIG. 1 is a diagrammatic representation of sector aligned radio assignments within an airspace 10. FIG. 1 illustrates an airspace 10 associated with an ATC facility 12 responsible for controlling the aircraft 14A-14I within the airspace 10. The airspace 10 is divided into three sectors 10A-10C. The ATC facility 12 communicates with a plurality of aircraft 14A-14I via ground radios 16A-16C. Although FIG. 1 depicts nine aircraft 14A-14I within the airspace 10 and three ground radios 16A-16C, there may be fewer or more aircraft and/or ground radios.

In accordance with the sector aligned radio assignment scheme, the aircraft 14A-14I are assigned to the ground radios 16A-16C based on sector boundary and aircraft location considerations. In this regard, a first one of the ground radios 16A is associated with a first one of the sectors 10A and aircraft 14A, 14B flying within the first sector 10A are assigned to the first ground radio 16A. A second one of the ground radios 16B is associated with a second one of the sectors 10B and aircraft 14C, 14D, 14E and 14F flying within the second sector 10B are assigned to the second ground radio 16B. A third one of the ground radios 16C is associated with a third one of the sectors 10C and aircraft 14G, 14H, 14I flying within the third sector 10C are assigned to the third ground radio 16C. Such sector aligned radio assignments may result in an unbalanced workload among the three ground radios 16A-16C. In this regard, for the situation depicted in FIG. 1, the first ground radio 16A provides communications with two aircraft 14A, 14B, the second ground radio 16B provides communications with four aircraft 14C-14F, and the third ground radio provides communications with three aircraft 14G-14I. Further, sector aligned radio assignments are made without regard to the extent of radio coverage provided by each ground radio 16A-16C as represented by the line-of-sight cones 18A-18C extending from each ground radio 16A-16C.

As the aircraft 14A-14I move through the airspace 10 they may cross sector boundaries requiring a change in radio assignment. For example, aircraft 14G is shown about to cross from the third sector 10C into the second sector 10B which requires that aircraft 14G be assigned to the second ground radio 16B. Furthermore, when one of the ground radios 16A-16C fails (e.g., the second ground radio 16B as shown), the outage is covered by a dedicated backup radio (not shown) associated with the same sector 10A-10C as the failed radio. In this regard, each of the ground radios 16A-16C may have a dedicated backup radio co-located therewith.

In the sector aligned radio assignment approach, physical radios and available channels are assigned by geographic region and additional radios and channels are deployed to handle experienced and predicted peak workloads. The assignment of radios and channels by the 'one sector-one controller-redundant radios' philosophy uses a coordinated hand-off between sectors/controllers from pre-determined radio-sector alignments. However, no efficiency in asset utilization is realized by the deployment of additional assets restricted to geographic regions.

Figure 2:
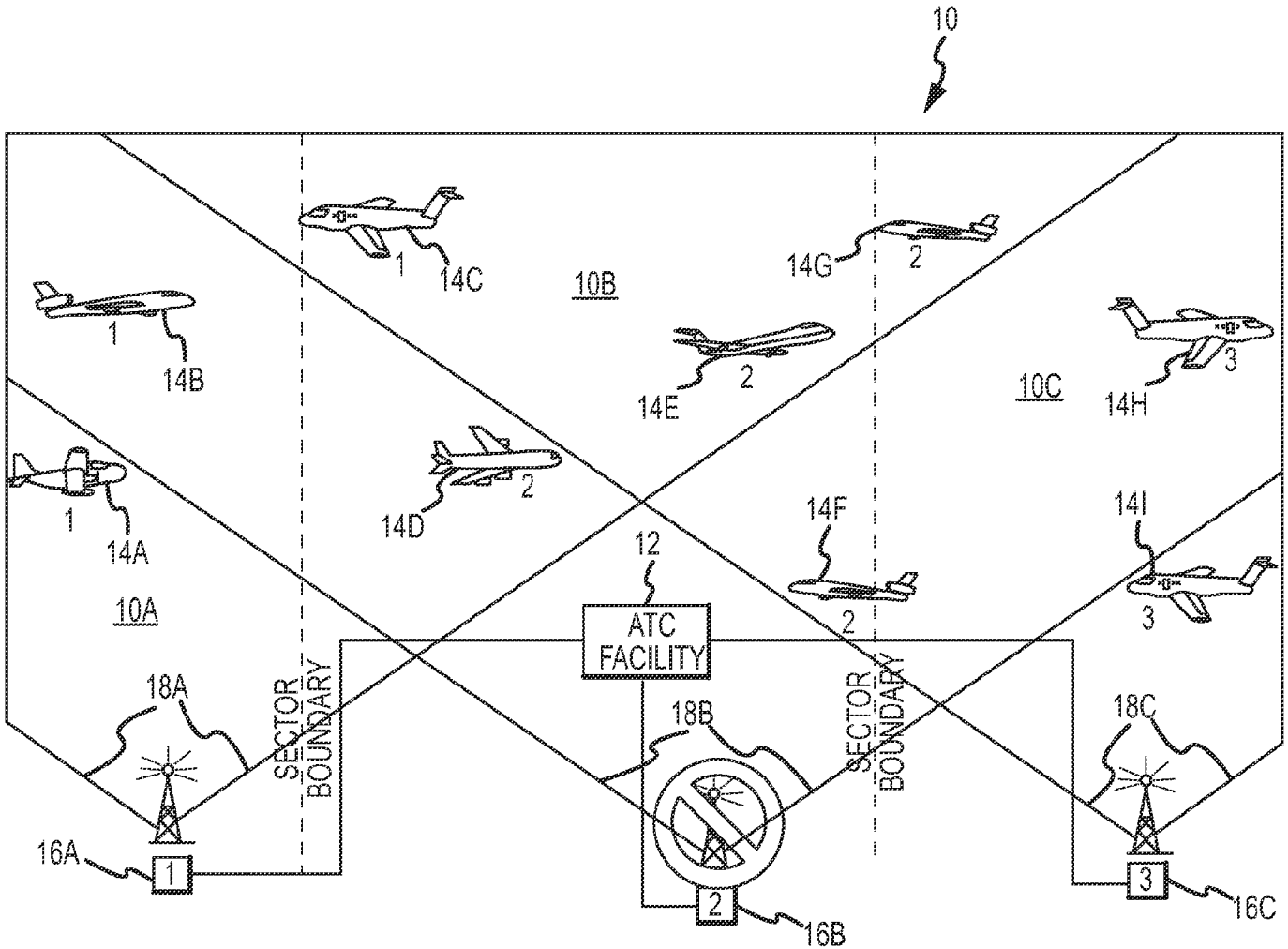
FIG. 2 is a diagrammatic representation of proximity aligned radio assignments within an airspace.

FIG. 2 is a diagrammatic representation of proximity aligned radio assignments within an airspace 10 wherein each airborne user 14A-14I will be assigned to the radio 16A-16C geographically closest to the airborne user's 14A-14I current position. Although FIG. 2 depicts nine aircraft 14A-14I within the airspace 10 and three ground radios 16A-16C, there may be fewer or more aircraft and/or ground radios.

In accordance with the proximity aligned radio assignment scheme, the aircraft 14A-14I are assigned to the ground radios 16A-16C based on ground radio 16-16C location and aircraft 14A-14I location considerations. For example, aircraft 14A, 14B, 14C are assigned to the first ground radio 16A based on their proximity to the first ground radio 16A, aircraft 14D, 14E, 14F and 14G are assigned to the second ground radio 16B based on their proximity to the second ground radio 16B, and aircraft 14H and 14I are assigned to the third ground radio 16C based on their proximity to the third ground radio 16C. Such proximity aligned radio assignments may also result in an unbalanced workload among the three ground radios 16A-16C. In this regard, for the situation depicted in FIG. 2, the first ground radio 16A provides communications between the ATC facility 12 responsible for controlling all of the aircraft 14A-14I within the airspace 10 and three of the aircraft 14A-14C, the second ground radio 16B provides communications between the ATC facility 12 and four of the aircraft 14D-14G, and the third ground radio 16C provides communications between the ATC facility and two of the aircraft 14H, 14I.

The proximity aligned radio assignment approach may allow reduction in deployed ground radios relative to the sector aligned radio approach. However, when limited to the use of existing radio sites, the proximity aligned radio assignment approach does not allow for the efficient use of ground radios and the greatest reduction in deployed assets. This alternative uses only the airborne user's 14A-14I position in relation to the deployed ground radios 16A-16C to make the radio assignment. Then an available channel on the selected ground radio 16A-16C is assigned. Furthermore, when one of the ground radios 16A-16C fails (e.g., the second ground radio 16B as shown), the outage is covered by the adjacent ground radios 16A-16C (e.g., the next most proximal ground radio 16A or 16C).

Figure 3:
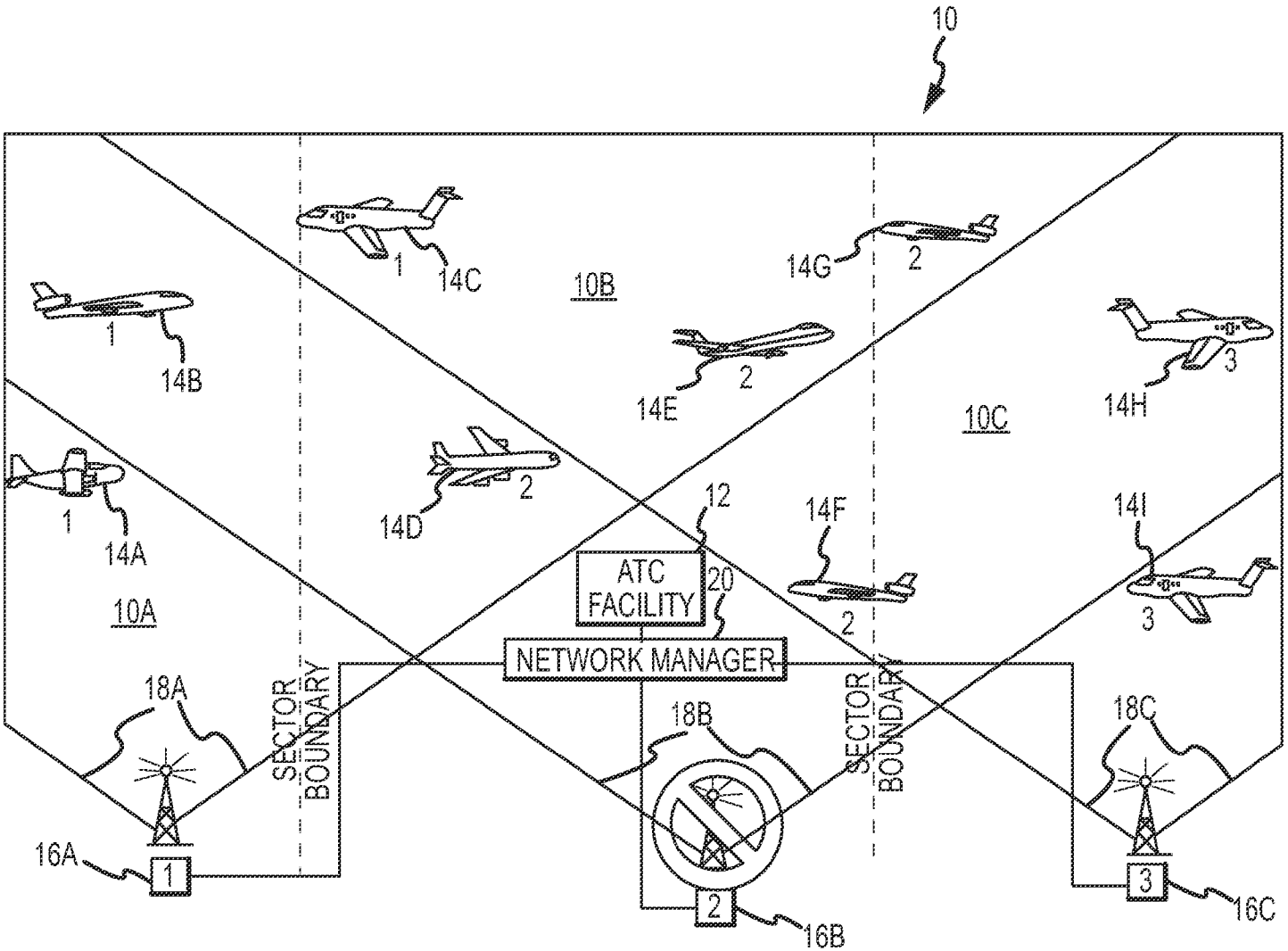
FIG. 3 is a diagrammatic representation of ATC coordinated radio assignments within an airspace.

FIG. 3 is a diagrammatic representation of ATC coordinated radio assignments within an airspace 10. Although FIG. 3 depicts nine aircraft 14A-14I within the airspace 10 and three ground radios 16A-16C, there may be fewer or more aircraft and/or ground radios. The ATC coordinated radio assignment scheme may be implemented using a system that includes a network manger 20 interposed between the ATC facility 12 responsible for controlling the aircraft 14A-14I within the airspace 10 and the ground radios 16A-16C. In this regard, the network manager 20 may be communicatively coupled to ATC facility 12 and the ground radios 16A-16C.

In accordance with the ATC coordinated radio assignment scheme, the aircraft 14A-14I are assigned to the ground radios 16A-16C by the network manager 20 based on a number of network management considerations including: (a) ground radio 16A-16C coverage (represented by cones 18A-18C); (b) ground radio 16A-16C duty cycle; (c) aircraft 14A-14I location; (d) aircraft 14A-14I intentions; and (e) signal power conflicts. In view of such considerations, for example, aircraft 14A, 14B, 14C are assigned to the first radio 16A, aircraft 14D, 14E, 14F and 14G are assigned to the second radio 16B, and aircraft 14H and 14I are assigned to the third radio 16C. Such ATC coordinated radio assignments by the network manager 20 results in a balanced workload among the three ground radios 16A-16C and minimum radio reassignments as a given aircraft (e.g., aircraft 14G) may remain assigned to a particular radio (e.g., ground radio 16B) throughout a significant portion if not the entirety of the airspace 10 without regard to sector crossings by the aircraft or closer proximity to another one of the ground radios (e.g., ground radios 16A or 16C).

In implementing the ATC coordinated radio assignment logic, the network manager may receive a number of inputs including ATC information inputs and ground radio information inputs. The ATC information inputs may be received by the network manager from the ATC facility 12 and/or the aircraft 14A-14I via the ground radios 16A-16C. The aircraft information inputs may include aircraft heading, aircraft speed, aircraft intention, present aircraft radio assignment, aircraft radio capability, and the current location of the aircraft within the airspace. The ground radio information inputs may, for example, be received by the network manager 20 from the ground radios 16A-16C and may, for example, include ground radio coverage, ground radio capacity, ground radio utilization, and ground radio location. After determining the ground radio assignments, the network manager 20 communicates information about the ground radio assignments to the ATC 12 and to the aircraft 14A-14I within the airspace 10. The network manager 20 may repeatedly update the ground radio assignments based on updated network management considerations, aircraft inputs and ground radio inputs, and may communicate updated information about the ground radio assignments to the ATC 12 and the aircraft 14A-14I within the airspace 10.

Figure 4:
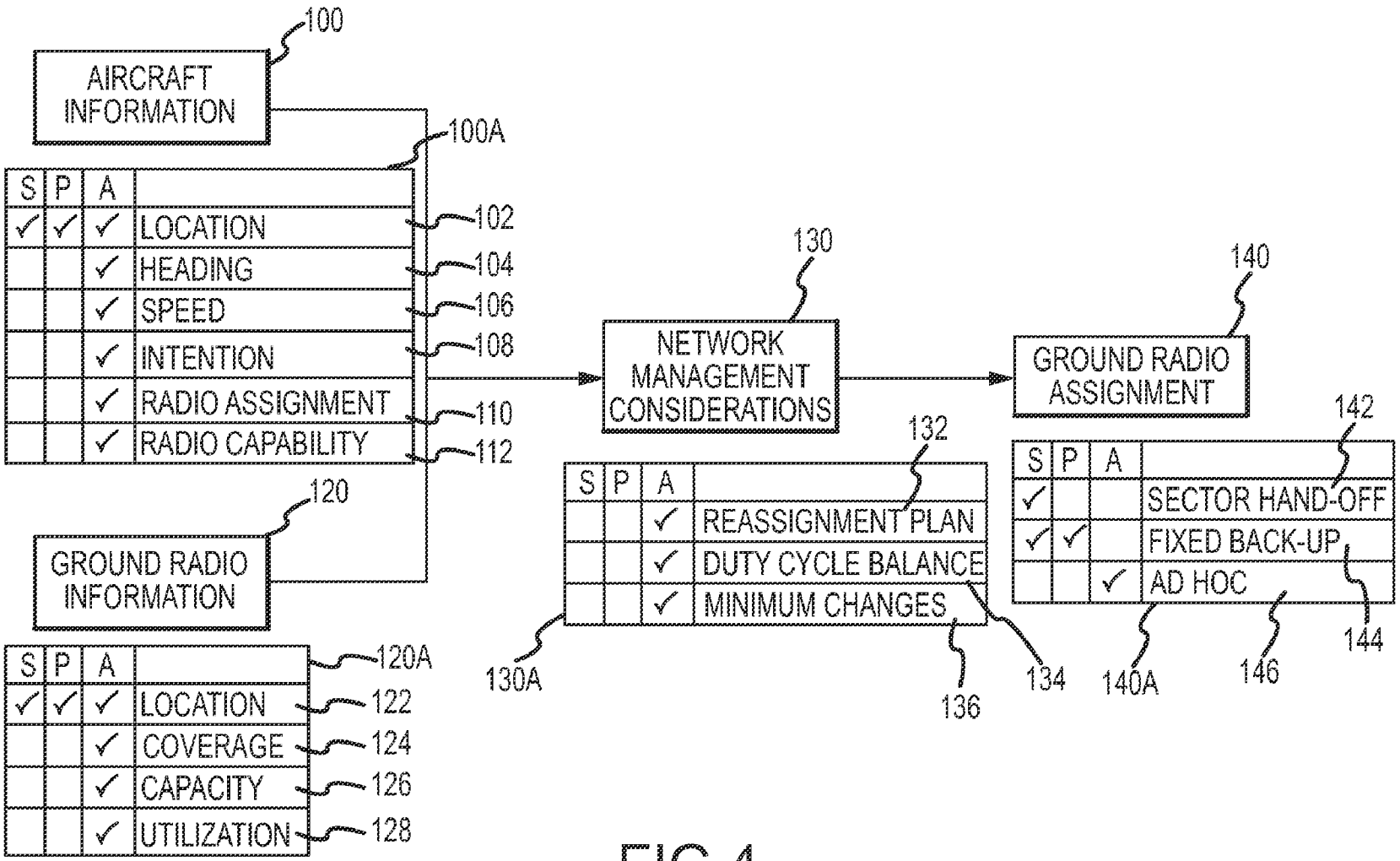
FIG. 4 is a chart that summarizes differences between sector or proximity aligned radio assignment and ATC coordinated radio assignment logic.

FIG. 4 summarizes differences between sector (pre-determined geographies) or proximity aligned radio assignment logic and ATC coordinated radio assignment logic. In FIG. 4, table 100A lists various aircraft information inputs 100, table 120A lists various ground radio information inputs 120, table 130A lists various network management considerations 130, and table 140A lists various ground radio assignment characteristics 140. In the tables 110A, 120A, 130A and 140A, the 'S' column corresponds with sector aligned radio assignment logic, the 'P' column corresponds with proximity aligned radio assignment logic, and the 'A' column corresponds with ATC coordinated radio assignment logic. As indicated by the single check-marks in the 'S' and 'P' columns of tables 110A and 120A, in the sector or proximity aligned radio assignment logic, aircraft information inputs 100 include only aircraft location 102 and ground radio information inputs 120 include only ground radio location 122. As indicated by the check-marks in the 'A' columns of tables 110A and 120A, in the ATC coordinated radio assignment logic, aircraft information inputs 100 may include heading 104, speed 106, intention 108, radio assignment 110, and radio capability 112 in addition to location 102, and ground radio information inputs 120 may include coverage 124, capacity 126, and utilization 128 in addition to location 122. The aircraft information inputs 100 and the ground radio information inputs 120 are processed in view of the network management considerations 130. As indicated by the lack of check-marks in the 'S' and 'P' columns of table 130A, in the sector or proximity aligned radio assignment logic, the listed network management considerations 130 are not involved. As indicated by the check-marks in the 'A' column of table 130A, in the ATC coordinated radio assignment logic, the network management considerations 130 may include a reassignment plan 132, duty cycle balance 134 and minimum changes 136. Processing of the aircraft information inputs 100 and ground radio information inputs 120 in view of the network management considerations 130 results in a ground radio assignment 140. As indicated by the check-marks in the 'S' column of table 140A, in the sector aligned radio assignment logic the ground radio assignment 140 is characterized as sector hand-off 142 and fixed back-up 144 in nature. As indicated by the check-mark in the 'P' column of table 140A, in the proximity aligned radio assignment logic the ground radio assignment 140 is characterized as fixed back-up 144 in nature. As indicated by the check-mark in the 'A' column of table 140A, in the ATC coordinated radio assignment logic, the ground radio assignment 140 is characterized as ad hoc 146 in nature.

Figure 5:
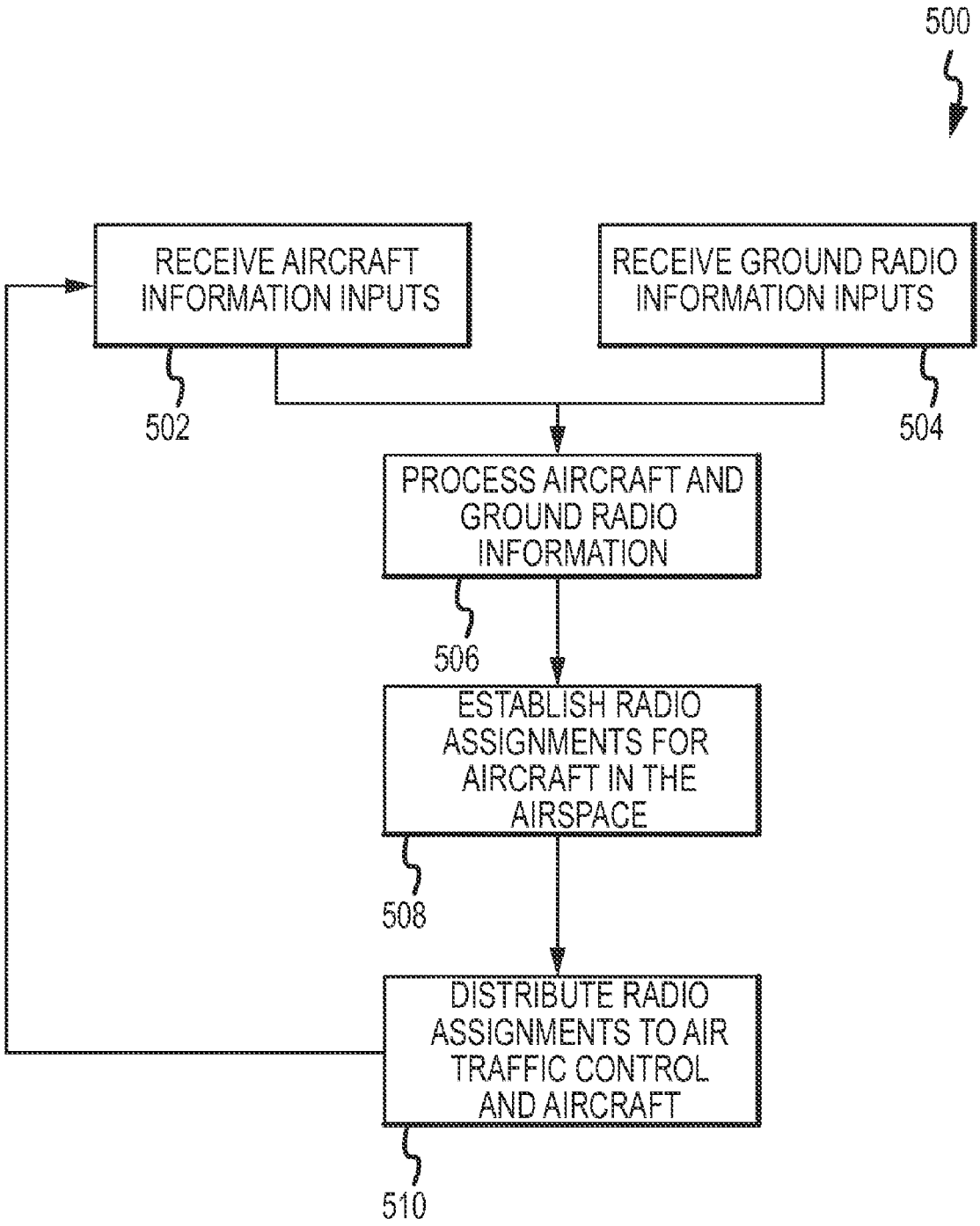
FIG. 5 is a flow chart showing the steps of one embodiment of a method of coordinating ground radio assignments for aircraft operating within a controlled airspace.

FIG. 5 shows the steps included in one embodiment of a method 500 of coordinating ground radio assignments for aircraft operating within a controlled airspace. One or more of the various steps of the method 500 may be completed at a network manager communicatively coupled to the air traffic control center controlling the airspace and a plurality of round radios providing communications between the air traffic control center and the aircraft within the airspace.

In step 502 of the method 500 a plurality of aircraft information inputs are received. The aircraft information inputs may, for example, include current aircraft location data, aircraft heading data, aircraft speed data, aircraft intentions data, existing aircraft radio assignment data, and aircraft radio capability data. One or more of the aircraft information inputs may, for example, be received from an air traffic control center.

In step 504 of the method 500 a plurality of ground radio information inputs are received. The ground radio information inputs may, for example, include ground radio coverage data, ground radio capacity data, ground radio utilization data, and ground radio location data. Such ground radio information inputs may, for example, be received from the ground radios and/or stored in a database prior to commencing the method 500.

The aircraft information inputs and the ground radio information inputs are processed in step 506. In this regard, the aircraft information inputs and the ground radio information inputs may be processed in accordance with network management considerations. The network management considerations may, for example, include a radio reassignment plan, achieving ground radio duty cycle balance, and minimizing changes in ground radio assignments among aircraft within the airspace.

In step 508, a ground radio assignment for each aircraft within the controlled airspace is established using the processed aircraft information inputs and the processed ground radio information inputs. The ground radio assignments may be established without considering sector crossings within the airspace by the aircraft and/or without considering proximity of the aircraft to particular ground radios.

In step 510, information about the ground radio assignments is distributed from the network manager to the air traffic control center and to the aircraft. The allows controllers and pilots, respectively, to communicate with one another using the assigned radios/channels.

Since the controlled airspace is not static and aircraft may be continuously entering or exiting the airspace, ground radio assignments for the aircraft may be reconsidered based on current aircraft information inputs, ground radio information inputs, and network management considerations. Reconsideration of the ground radio assignments may, for example, take place periodically or it may be triggered when an aircraft enters or exists the airspace.

While various embodiments of the present invention have been described in detail, further modifications and adaptations of the invention may occur to those skilled in the art. However, it is to be expressly understood that such modifications and adaptations are within the spirit and scope of the present invention.

What is claimed is:

1. A system that coordinates assignments of aircraft operating within a controlled airspace to ground radios, said system comprising:

an air traffic control facility configured for controlling air traffic within the airspace and providing air traffic control information;

a plurality of ground radios configured to provide communications between said air traffic control facility and the aircraft;

a network manager communicatively coupled to said air traffic control center and said ground radios, said network manager being configured to assign each aircraft within the airspace to a ground radio based on network management considerations using the air traffic control information;

and wherein said network management considerations include radio coverage within the airspace, radio duty cycle, aircraft location within the airspace, aircraft intentions, and signal power conflicts.

2. The system of claim 1 wherein said network manager assigns each aircraft to a radio without regard to sector crossings within the airspace by the aircraft.

3. The system of claim 1 wherein said network manager assigns each aircraft to a radio without regard to proximity of the aircraft to particular radios.

4. The system of claim 1 wherein said network manager receives aircraft information inputs including the air traffic control information.

5. The system of claim 4 wherein said aircraft information inputs include aircraft heading data, aircraft speed data, aircraft intention data, aircraft radio assignment data, aircraft radio capability data and current aircraft location data.

6. The system of claim 1 wherein said network manager receives ground radio information inputs.

7. The system of claim 6 wherein said ground radio information inputs include ground radio coverage data, ground radio capacity data, ground radio utilization data, and ground radio location data.

8. The system of claim 1 wherein said network manager is further configured to distribute information about the ground radio assignments to said air traffic control center and to the aircraft.

9. The system of claim 1 where said network manager is further configured to reconsider ground radio assignments for aircraft within the airspace based on current network management considerations and current air traffic control information when aircraft enter or exit the airspace.

10. The system of claim 1 where said network manager is further configured to periodically reconsider ground radio assignments for aircraft within the airspace based on current network management considerations and current air traffic control information.

11. The system of claim 1 wherein said plurality of ground radios includes digital radios.

12. A method of coordinating ground radio assignments for aircraft operating within a controlled airspace to ground radios, said method comprising the steps of:

receiving a plurality of aircraft information inputs;

receiving a plurality of ground radio information inputs;

processing the aircraft information inputs and the ground radio information inputs in view of network management considerations; and establishing, for each aircraft, an assignment to one of the ground radios using the processed aircraft information inputs and the processed ground radio information inputs;

wherein said step of receiving a plurality of aircraft information inputs comprises:

receiving aircraft heading data, aircraft speed data, aircraft intention data, aircraft radio assignment data, aircraft radio capability data and current aircraft location data;

wherein at least one of the aircraft heading data, aircraft speed data, aircraft intention data, aircraft radio assignment data, aircraft radio capability data and current aircraft location data is received from an air traffic control center.

13. The method of claim 12 wherein said step of receiving a plurality of ground radio information inputs comprises:

receiving ground radio coverage data, ground radio capacity data, ground radio utilization data, and ground radio location data.

14. The method of claim 13 wherein at least one of the ground radio coverage data, ground radio capacity data, ground radio utilization data, and ground radio location data is stored prior to commencing said method.

15. The method of claim 12 wherein in said step of processing, the network management considerations include a ground radio reassignment plan, achieving ground radio duty cycle balance, and minimizing changes in ground radio assignments among aircraft within the airspace.

16. The method of claim 12 wherein in said step of establishing, the assignment to a ground radio is made, for each aircraft, without considering sector crossings within the airspace by the aircraft.

17. The method of claim 12 wherein in said step of establishing, the assignment to a ground radio is made, for each aircraft, without considering proximity of the aircraft to particular ground radios.

18. The method of claim 12 said steps of receiving a plurality of aircraft information inputs, receiving a plurality of ground radio information inputs, processing the aircraft information inputs and the ground radio information inputs, and establishing, for each aircraft, an assignment to a ground radio are completed at a network manager interposed between an air traffic control center controlling the airspace and a plurality of round radios.

19. The method of claim 18 further comprising:

distributing information about the ground radio assignments from the network manager to the air traffic control center and to the aircraft.

20. The method of claim 12 further comprising:

reconsidering ground radio assignments for aircraft within the airspace based on current aircraft information inputs, ground radio information inputs, and network management considerations when an aircraft enters or exists the airspace.

21. The method of claim 12 further comprising:

periodically reconsidering ground radio assignments for aircraft within the airspace based on current aircraft information inputs, ground radio information inputs, and network management considerations.

22. The method of claim 12 wherein the ground radios include digital radios.

* * * * *